US005643398A

United States Patent [19]

Lumberg

[11] Patent Number: 5,643,398

[45] Date of Patent: Jul. 1, 1997

[54] LOG TAIL SEALER

[75] Inventor: Eric J. Lumberg, Ashland, Wis.

[73] Assignee: C. G. Bretting Manufacturing Company, Inc., Ashland, Wis.

[21] Appl. No.: 440,701

[22] Filed: May 15, 1995

[51] Int. Cl.[6] ..... B31C 13/00

[52] U.S. Cl. ..... 156/446; 156/449; 156/578; 118/243; 242/533.2

[58] Field of Search ..... 156/446, 449, 156/450, 452, 187, 191, 578; 118/243; 242/533, 533.2, 533.3, 541.2

[56] References Cited

U.S. PATENT DOCUMENTS

| | | | |
|---|---|---|---|
| 2,573,188 | 10/1951 | Dyken | 242/533.2 X |
| 2,755,768 | 7/1956 | Olson | 118/243 X |
| 3,415,221 | 12/1968 | Stenger | 118/243 |
| 4,328,931 | 5/1982 | Gordon-Clark et al. | 242/534 |
| 4,456,190 | 6/1984 | Karttunen et al. | 242/533.2 X |
| 4,475,974 | 10/1984 | Perini | 156/187 |
| 4,586,645 | 5/1986 | Harada | 228/15.1 |
| 4,609,421 | 9/1986 | Yui | 118/243 X |
| 5,242,525 | 9/1993 | Biagiotti | 156/357 |
| 5,259,910 | 11/1993 | Biagiotti | 156/456 |
| 5,478,430 | 12/1995 | Marchetti | 156/468 |

*Primary Examiner*—James Engel
*Attorney, Agent, or Firm*—Reinhart, Boerner, Van Deuren, Norris & Rieselbach, s.c.

[57] ABSTRACT

An apparatus and method for sealing a loose tail of wound material against a log using an infeed and log reject station, a tail separator station and a tail ironing and log discharge station. The apparatus and method receives a log on a pair of rider rolls and directs one or more air jets against the log to cause the tail to extend away from the log and captures the tail on a vacuum table as controlled by an optical sensor monitoring the table. The log then progresses to a glue table where a stripe of glue is applied through an aperture in the table by a glue transfer bar rotating out from being submerged in a glue reservoir. The log is then received between three ironing rolls which compress the tail against the log and discharge the log from the ironing rolls by moving an ejector arm from a rest position between two of the ironing rolls towards the third ironing roll to an ejecting position intermediate all three ironing rolls.

14 Claims, 8 Drawing Sheets

LOG TAIL SEALER

BACKGROUND OF THE INVENTION

This invention relates to the field of wound logs of paper and the like, and more particularly, to an improved apparatus and method of sealing the tail of the material to the log and thereafter discharging the log from the apparatus.

DETAILED DESCRIPTION OF THE INVENTION

Figure 1:
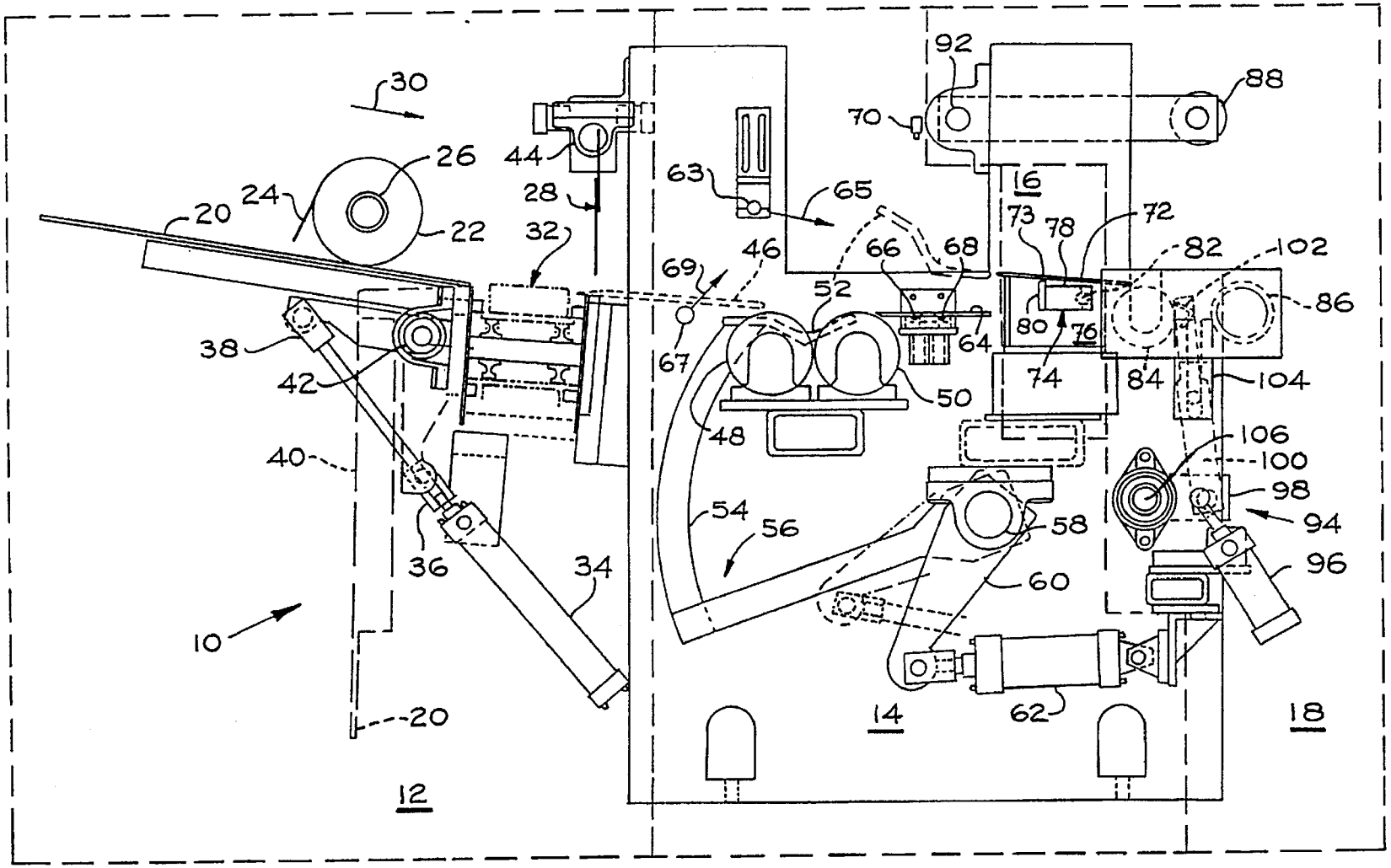
FIG. 1 is a side view of a log tail sealer machine useful in the practice of the present invention.

Referring now to the figures, and most particularly to FIG. 1, a simplified view of a log tail sealer apparatus 10 may be seen. Sealer apparatus 10 is ordinarily used with a rewinder apparatus (not shown) which winds material such as paper into relatively small diameter elongated rolls, called "logs." Such logs are eventually cut into short segments resulting in rolls of paper towels or toilet paper, for example, depending upon the specific material wound into the logs.

The sealer apparatus 10 is useful in that the logs will ordinarily have a tail (or end of the material wound) hanging loosely from the log, and if left free, the tail may unwind and interfere with further handling of the log. The sealer apparatus 10 temporarily separates the tail from the log, applies glue to the log in the region exposed by the separated tail, and then "irons" the tail back against the log, securing the tail to the log for neat and orderly further processing of the log. Finally the log is ejected from the sealer apparatus 10 by an ejector arm. This is accomplished by the sealer apparatus having an infeed and log reject station or apparatus 12, a tail separator station or apparatus 14, a glue station or apparatus 16, and a tail ironing and log discharge station or apparatus 18.

The infeed and log reject station 12 has a first inclined table 20 to receive a log 22 having a loose tail 24 after typically having been wound on a cardboard core 26. Log 22 moves by gravity along inclined table 20, and comes to rest against a reject gate 28, since table 20 is inclined downwardly in a downstream direction 30. When log 22 is adjacent gate 28, it can be rejected by a reject conveyor 32. Conveyor 32 is selectively actuated to reject defective logs by moving them transverse to the downstream direction 30. Returning to table 20, an air cylinder 34 has a piston movable to a first position 36 and a second position 38. First position 36 causes and corresponds to a vertical position 40 for table 20, since table 20 is mounted to sealer 10 via a pivot 42. Actuation cylinder 34 to the second position 38 will cause table 20 to be in the position shown in solid lines in FIG. 1. The vertical position 40 for table 20 is provided to allow for access to the infeed and log reject station and to any equipment upstream thereof for cleaning and the like.

Gate 28 is movable about pivot 44 to permit logs to pass to a second inclined table 46. Since table 46 is inclined downwardly in the downstream direction, the log 22 will move by gravity to the tail separator station 14 where it will come to rest on a pair of rider rolls 48, 50. Each of rider rolls 48, 50 is grooved to permit each of a plurality of concave fingers 52 to be positioned below the outer circumference of the rider rolls 48, 50. In addition, it is to be understood that both rolls 48, 50 are rotatable, and at least one is selectively operable to be driven to rotate a log received thereon. Fingers 52 are rigidly secured to a plurality of log lift arms 54 only one of which is shown, but all of which are part of a log lift assembly 56. Assembly 56 is selectively rotatable about pivot 58, via bellcrank 60 which is selectively operable by air cylinder 62.

A first air jet 63 is located above rider roll 48 and provides a stream or jet of air directed at about 15 degrees below the horizontal, as indicated by arrow 65. A second air jet 67 is located upstream of the first air jet 63 and directs a second stream or jet of air at about 45 degrees above the horizontal, as indicated by arrow 69.

A vacuum table 64 is located downstream of rider rolls 48 and 50 and preferably has a pair of rows of vacuum ports 66, 68 therein. An optical sensor 70 is preferably located above table 64 to monitor the presence and absence of a tail, i.e., sheet of material from the log thereon.

The glue station 16 includes a third inclined table 72, a movable glue applicator 74, and a glue reservoir 76 containing liquid glue 77. Applicator 74 preferably includes a plurality of radially projecting arms 78 secured to an elongated glue transfer bar 80. Applicator 74 is rotatable about a pivot point 82 (by any conventional means, not shown, but which may be, e.g., an air cylinder or servomotor or other rotary actuator) from a first position wherein the bar 80 is located below the surface of glue 77 in the reservoir 76 to a second position (as shown in FIG. 1) wherein the bar projects through an aperture 73 in table 72 to apply a glue line to a log positioned over the aperture 73.

Figure 2:
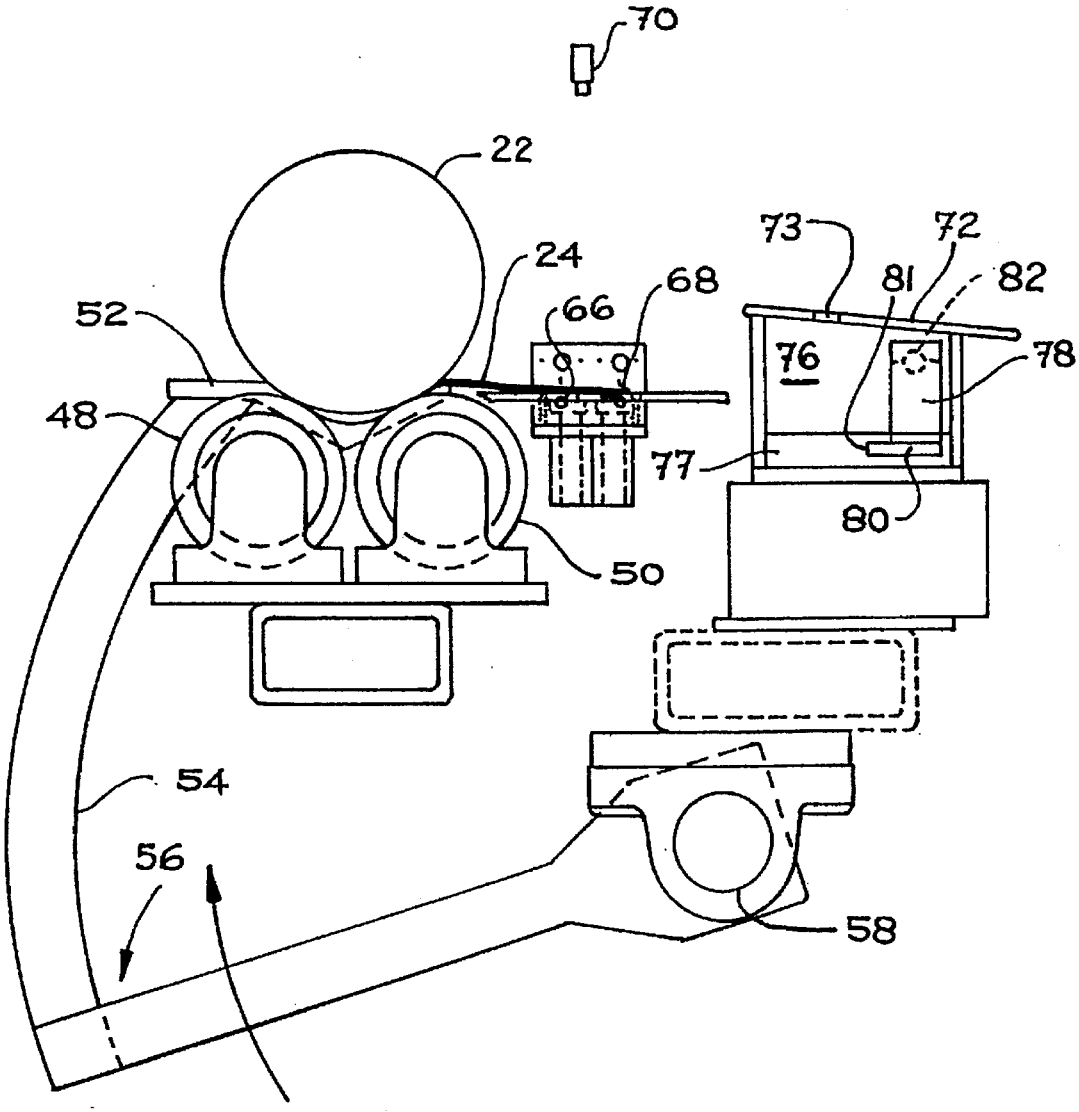
FIG. 2 is a detailed view of the tail separator station and glue station of the log tail sealer machine of FIG. 1 showing parts in a first position.
Figure 3:
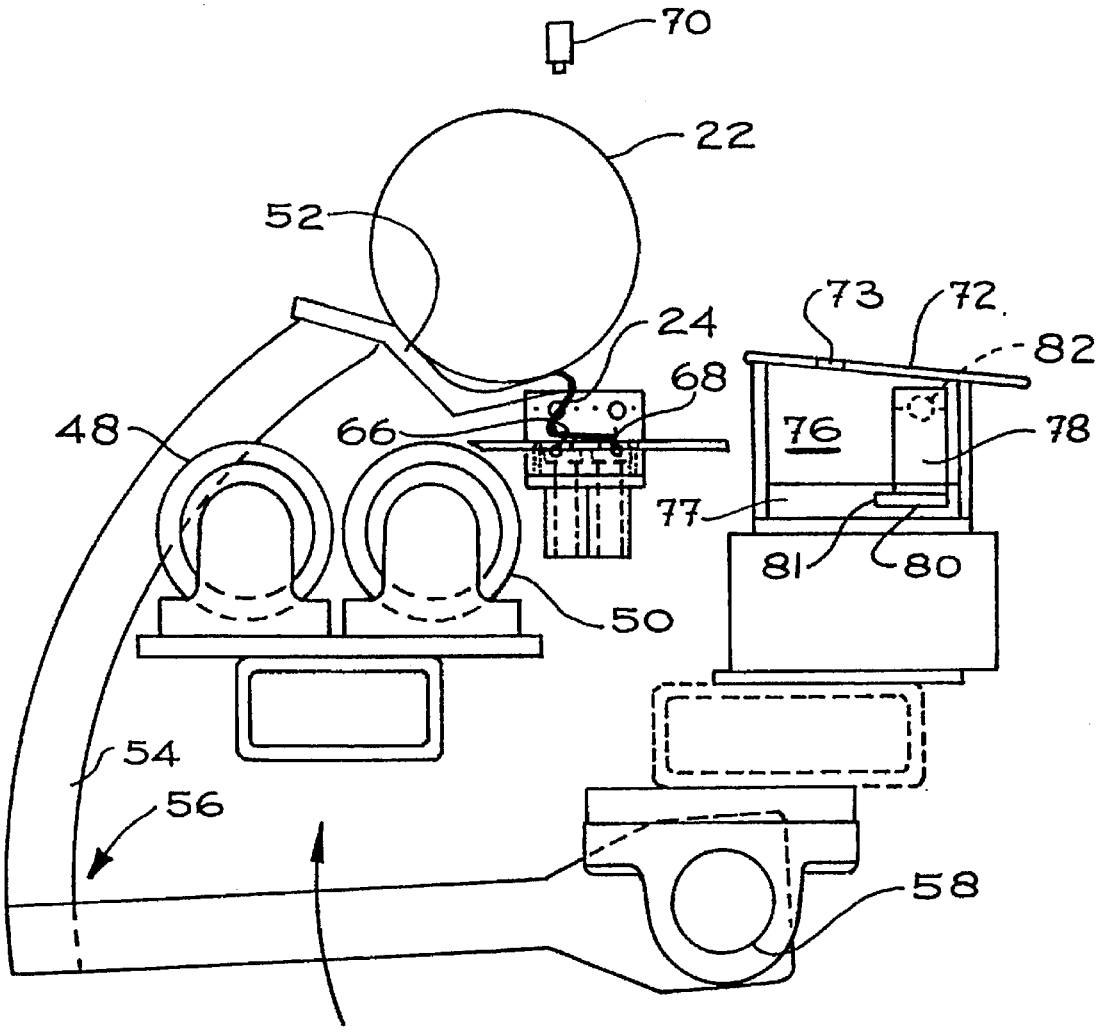
FIG. 3 is a detailed view of the tail separator station and glue station of FIG. 2 showing parts in a second position.

More particularly, as may be seen most clearly in FIGS. 2 and 3, bar 80 has an edge 81 offset so as to project laterally away from arms 78 to provide a salient surface to project into aperture 73.

The tail ironing and log discharge station 18 includes three ironing rolls 84, 86, 88. Ironing rolls 84 and 86 are preferably fixed and roll 88 is mounted on an arm 90 for movement of roll 88 toward and away from the other two ironing rolls 84 and 86. Arm 90 is mounted to pivot 92. At least one of the ironing rolls 84 and 86 is selectively driven and all three are free to rotate about their respective axes. It is to be understood that the movement of arm 90 is controlled, for example, by an air cylinder (not shown) to apply compression to a log positioned between rolls 84, 86, and 88. A log eject assembly 94 is also part of station 18. Assembly 94 has a conventional air cylinder 96 to selectively operate drag link 98 and eject arm 100. Ejector arm 100 preferably has an angle bracket 102 mounted transversely to apply pressure to discharge a log from between rolls 84, 86, and 88.

Turning now to FIGS. 2–8, the operation of log tail sealer 10 is as follows. After log 22 is received on table 20, gate 28 will stop and hold it at the reject conveyor 32. Ordinarily the first two logs after a change in the parent roll on the upstream rewinder (not shown) will be defective and will automatically be rejected by actuation of conveyor 32 to drive the logs transversely to the downstream direction (indicated by arrow 30). If any other logs are deemed unacceptable by an operator of sealer 10, they may also be rejected. The reject gate remains closed and the reject conveyor will transport defective logs out of the side of the sealer apparatus 10. During normal operation (with a non-defective log 22) the reject gate will rotate about pivot 44 and allow log 22 to progress to the second inclined table 46 and onto the rider rolls 48, 50.

Once the log 22 is positioned on the rider rolls 48, 50 at the tail separator station 14, the rider rolls 48, 50 are rotated, causing log 22 to rotate clockwise at preferably about 100 RPM. During rotation of log 22 by the rider rolls, the first air jet 63 and second air jet 67 direct air against log 22 while the log is at the tail separator station 14. More particularly the air jets 63, 67 direct air along directions indicated by arrows 65 and 69 resulting in air flow between tail 24 and log 22, causing the tail 24 to extend outwardly of the log 22. As the tail extends outwardly, it falls onto vacuum table 64 and covers both rows of vacuum ports 66,68, which are separately fed. A combination of vacuum and gravity causes the tail 24 to lay flat on the table 64. When the optical sensor or photo eye 70 senses that the tail is on the table 64, a signal is processed by a programmable controller (not shown) to cause the rotation of rolls 48, 50 and hence log 22 to stop with the tail just covering the rows of vacuum ports 66, 68, as may be seen most clearly in FIG. 2.

Referring now most particularly to FIG. 3, the log is now transferred from the tail separator station 14 to the gluing apparatus 16 by the log lift assembly 56. More particularly, air cylinder 62 moves bellcrank 60, rotating arm 54 and lifting log 22 with a plurality of generally concave fingers 52. During this operation, the tail 24 remains held against table 64 by vacuum ports 66, 68. It is to be understood that vacuum is provided to row 66 separately from row 68 to ensure that if the edge of tail 24 moves off row 68, suction will remain on the tail 24 via ports 66.

Figure 4:
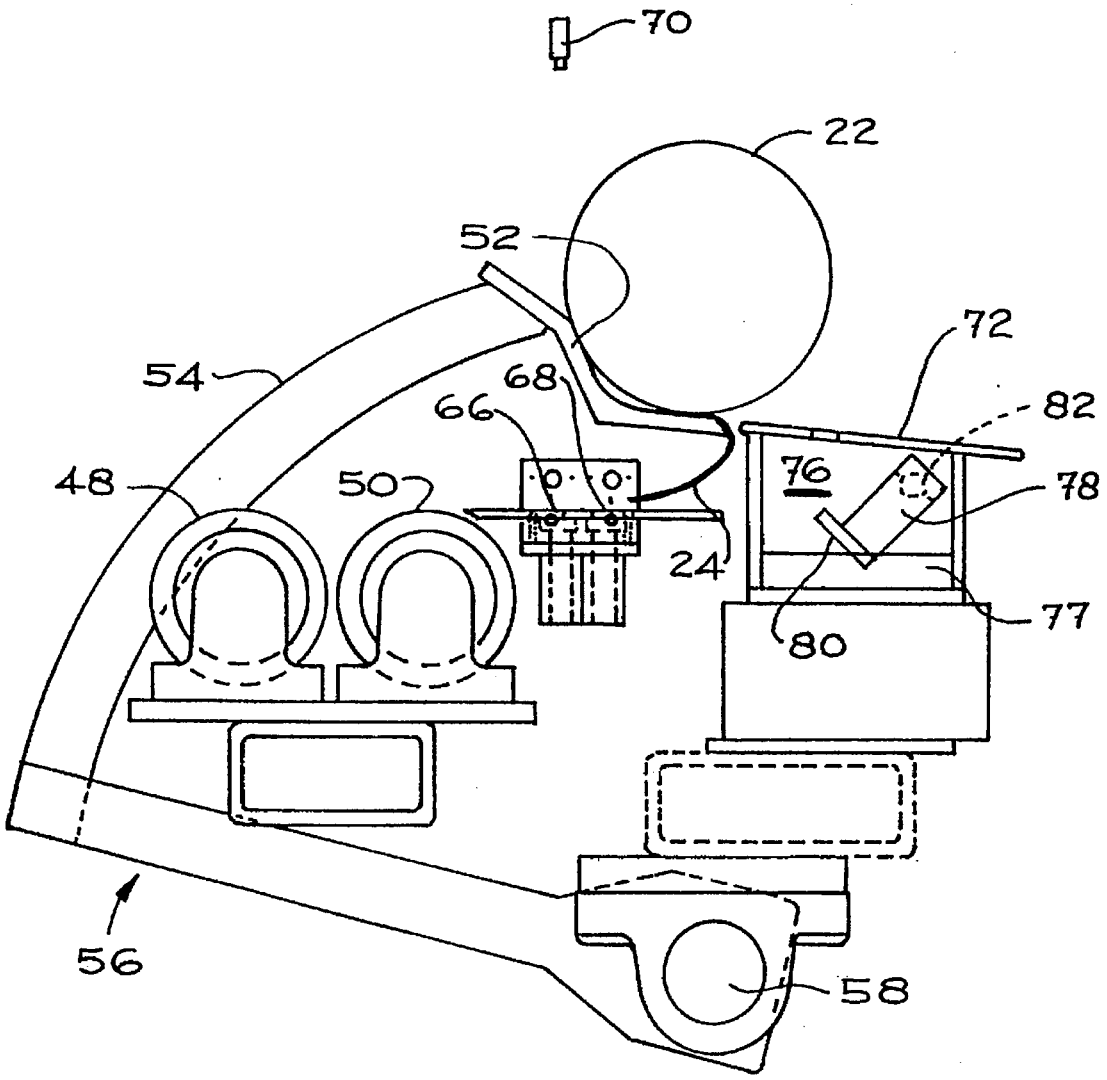
FIG. 4 is a detailed view of the tail separator station and glue station of FIG. 2 showing parts in a third position.

Once the log 22 reaches the glue station 16 and rests on glue table 72, vacuum is shut off to both rows of vacuum ports in table 64, as indicated by FIG. 4. If the photo eye 70 does not sense tail 24 on table 64, glue applicator 74 will remain in the reservoir 76 and not move up to the "up" position (shown in FIG. 5). This allows a log 22 which has not has its tail extended to progress through the sealer apparatus 10 without glue being applied to eliminate downstream contamination that would likely result from such improperly applied glue.

Figure 5:
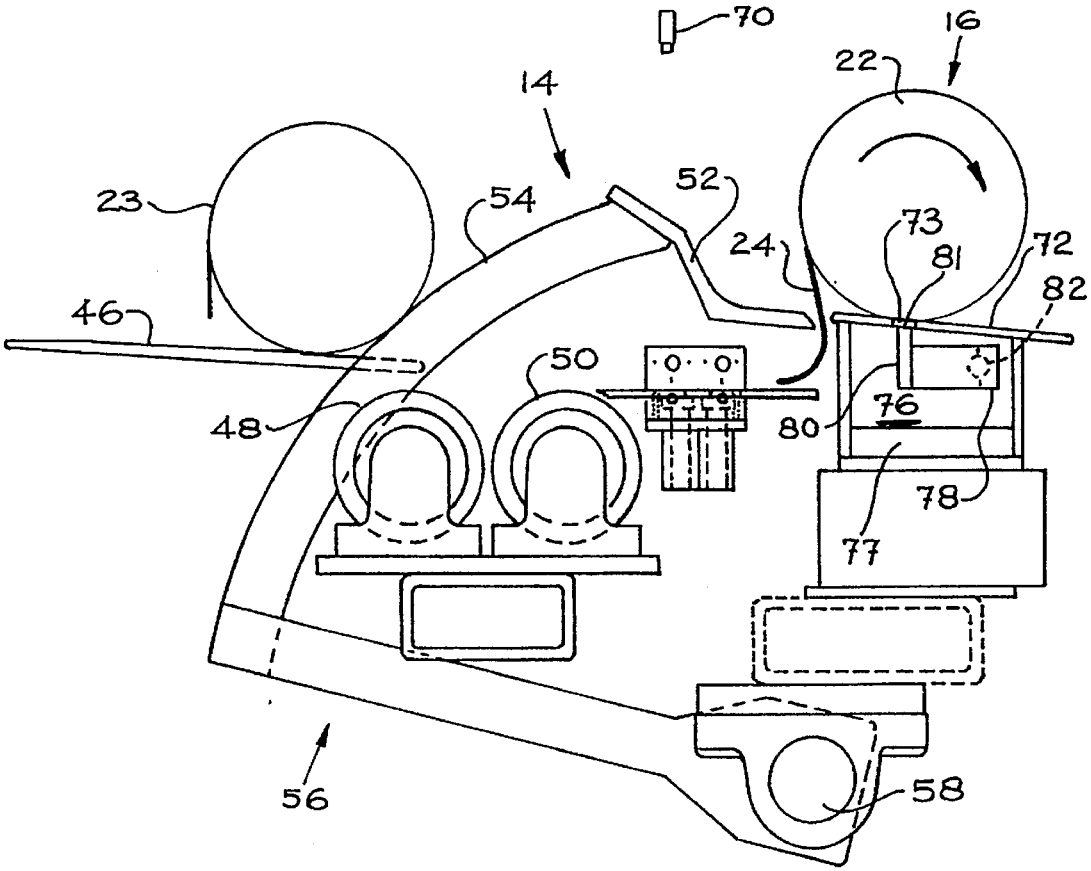
FIG. 5 is a detailed view of the tail separator station and glue station of FIG. 2 showing the log at the glue station.
Figure 6:
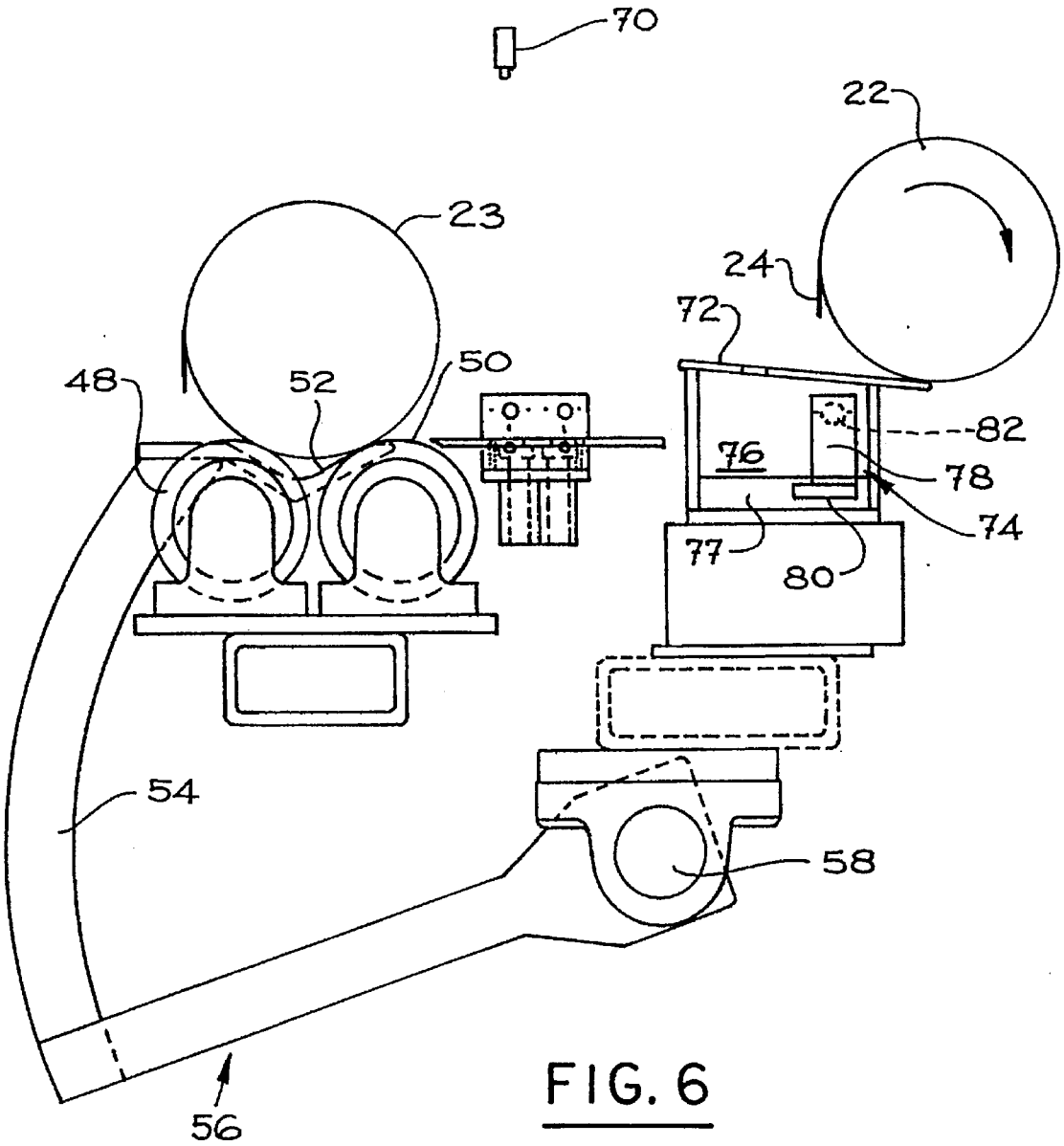
FIG. 6 is a detailed view of the tail separator station and glue station of FIG. 2 showing the log moving from the glue station and parts returned to the first position.

Progressing now to FIG. 5, log 22 will roll along the inclined glue table 72 and will receive a line of glue (in the region interior of the tail 24) from the projecting edge 81 of the bar 80 of glue applicator 74 positioned in aperture 73 of the table 72. FIG. 5 also shows a second or successive log 23 positioned on table 46, ready to be received at the tail separating apparatus 14. However, during the time that the log lift assembly 56 is delivering the first log 22 to the gluing apparatus 16, the plurality of log lift arms 54 block log 23 from moving from table 46 to rider rolls 48, 50. Once the assembly 56 retracts to the position shown in FIGS. 1 and 2, the second log 23 will progress to the tail separator station 14 and be received on rider rolls 48, 50, as shown in FIG. 6. Allowing the next log 23 to rest against arms 54 during delivery of the previous log 22 to the gluing apparatus 16 permits staging successive logs 22, 23 closer together and can enable a faster cycle time for the log tail sealer apparatus 10.

Figure 7:
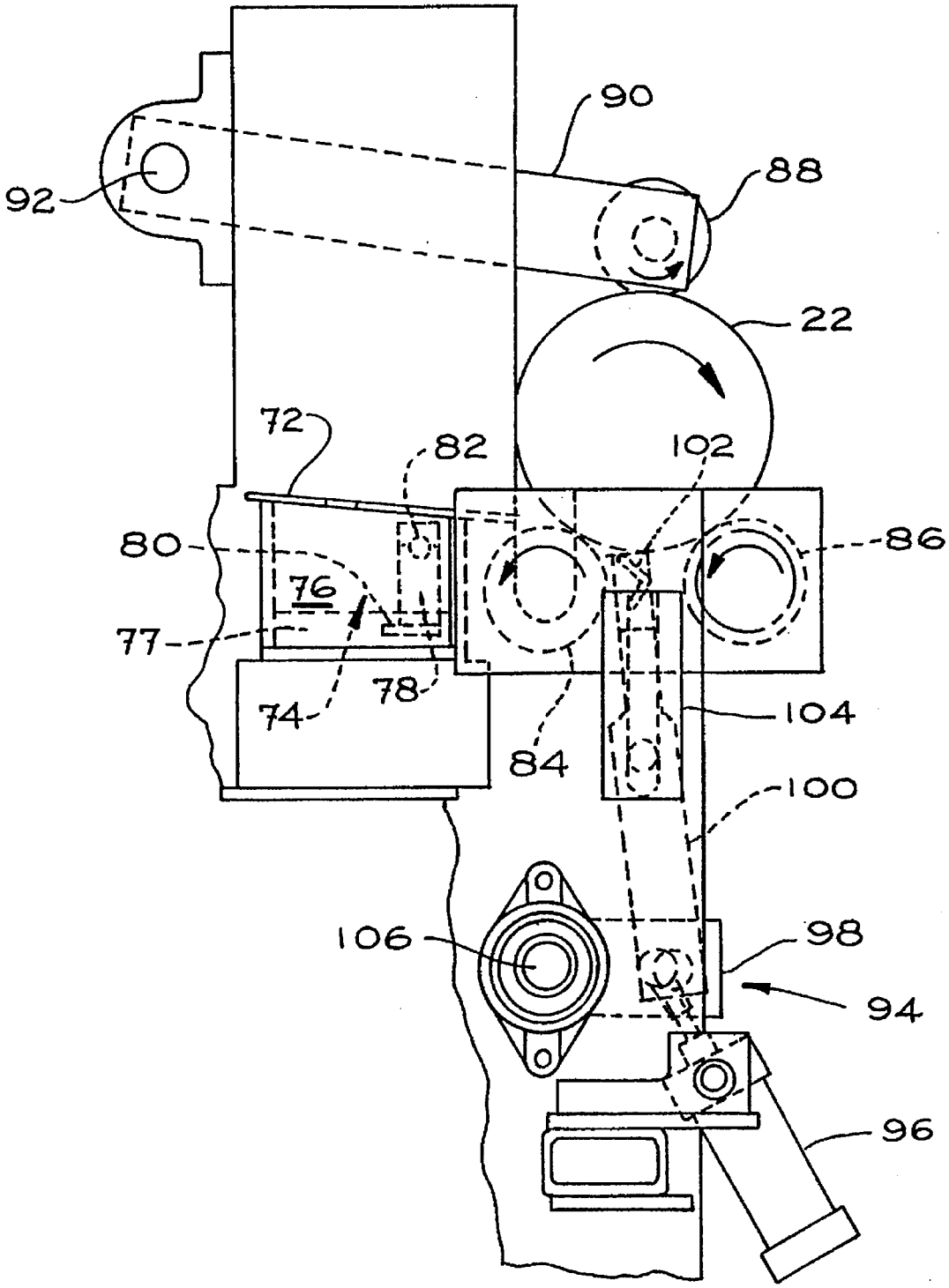
FIG. 7 is a detailed view of the tail ironing and log discharge station showing parts in a first position for ironing the tail to the log.
Figure 8:
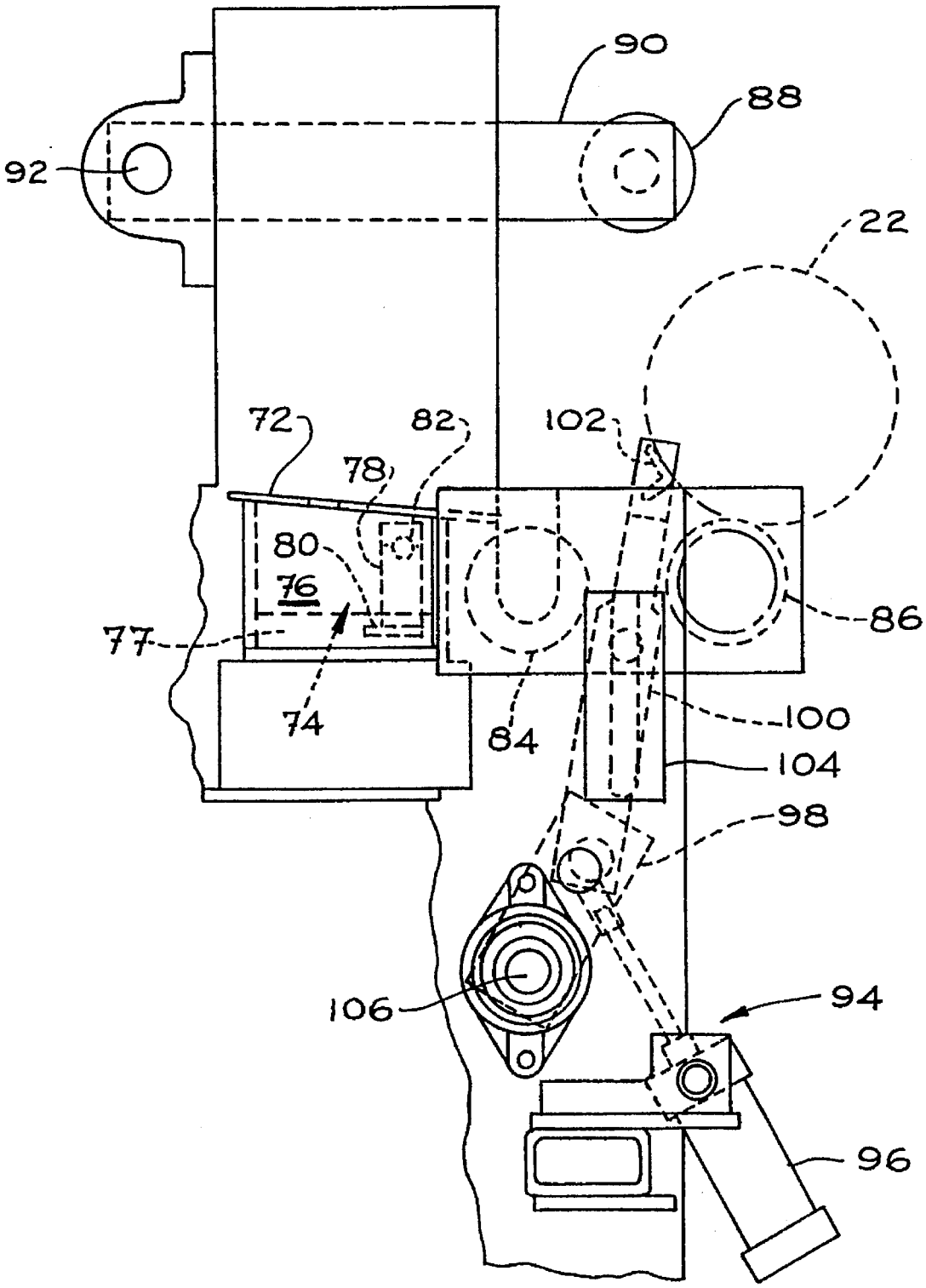
FIG. 8 is a detailed view of the tail ironing and log discharge station showing parts in a second position discharging the log.

Referring now to FIG. 6, log 22 will continue by gravity to roll off table 72, and come to rest on ironing rolls 84, 86, it being understood that roll 88 is retracted at this time by arm 90 to allow log 22 to enter the tail ironing and log discharge station 18. It is also to be noted that the glue applicator 74 will return to the "ready" position shown in FIG. 6 (with the applicator 74 immersed in the glue 77) as the log 22 exits the glue station 16. In normal operation, after the log exits the glue station 16, it enters the tail ironing and log discharge station 18. More particularly, the log 22 will roll off glue table 72 and come to rest between ironing rolls 84 and 86, as shown in FIG. 7. Arm 90 will move roll 88 towards the log 22 and the other two ironing rolls 84, 86 and apply pressure, compressing tail 24 against log 22, as the ironing rolls are driven at about 200 to 300 RPM. The ironing rolls are then stopped, arm 90 retracts to the position shown in FIG. 8, and the log eject assembly 94 is actuated, moving from the position shown in FIG. 7 to that shown in FIG. 8. It has also been found preferable that the ironing rolls be stopped at a location causing the glue line to be properly positioned (typically in the top hemisphere of the log) as the log 22 is discharged from the sealer apparatus 10. In more detail, the log eject assembly operation starts with actuation of air cylinder 96, driving eject arm upward along guides 104 via drag link 98 rotating about pivot 106 until angle bracket 102 contacts and discharges log 22, all as shown in FIG. 8. Eject assembly 94 will then return to the position shown in FIG. 7.

The invention is not to be taken as limited to all of the details thereof as modifications and variations thereof may be made without departing from the spirit or scope of the invention.

What is claimed is:

1. A tail sealing apparatus for sealing a loose tail of wound material to a log and having a tail separator apparatus for separating the loose tail away from a log of wound material, a gluing apparatus applying glue to the log, and a tail ironing apparatus for compressing the tail against the glue on the log, wherein the gluing apparatus comprises a pivoting glue applicator having a glue transfer movable from a first position wherein the glue transfer bar is submerged in a glue reservoir to a second position out of the glue reservoir wherein the glue transfer bar is in contact with the log, and said tail sealing apparatus further comprising a log lift assembly having a plurality of fingers pivotable to move the log from the tail separator apparatus to the gluing apparatus while the tail is retained by a vacuum table intermediate the tail separator apparatus and the gluing apparatus.

2. The tail sealing apparatus of claim 1 wherein the glue applicator further comprises a plurality of supports extending between the glue transfer bar and a rotatable shaft for moving the glue transfer bar between the first and second positions.

3. The tail sealing apparatus of claim 1 wherein the glue transfer bar has an edge for applying the glue to the log.

4. The tail sealing apparatus of claim 1 wherein the glue transfer bar is mounted to the plurality of supports such that the edge extends away from the plurality of supports.

5. The tail sealing apparatus of claim 1 further comprising a glue table positioned above the glue reservoir.

6. The tail sealing apparatus of claim 1 further comprising a glue table having an aperture therein, and wherein the glue transfer bar projects into the aperture in the second position and transfers glue to the log through the aperture when the log is received on the glue table and aligned with the aperture.

7. The tail sealing apparatus of claim 1 further comprising a log eject arm movable from a first position out of contact with the log to a second position in contact with the log while the log is at the tail ironing apparatus to displace the log from the ironing apparatus.

8. The tail sealing apparatus of claim 7 wherein the tail ironing apparatus includes three tail ironing rolls and the log eject arm is positioned between two of the ironing rolls in the first position and is positioned in the region intermediate all three ironing rolls in the second position.

9. The tail sealing apparatus of claim 1 further comprising an infeed and log reject apparatus upstream of the tail separator apparatus and having i) an infeed table inclined downward in the downstream direction, ii) a reject conveyor located downstream of the infeed table and oriented transverse to the downstream direction to selectively reject logs determined to be defective, and iii) a reject gate located downstream of the reject conveyor and movable to a first position to block logs from moving downstream past the reject conveyor, and a second position to allow logs to move downstream past the reject conveyor.

10. The tail sealing apparatus of claim 9 wherein the infeed table is movable from the inclined position to a generally vertical position to enable access to the infeed and log reject station and any equipment upstream thereof for cleaning and the like.

11. A tail sealing apparatus for sealing a loose tail of wound material to a log of the type having a tail separator apparatus for separating the loose tail away from a log of wound material, a gluing apparatus applying glue to the log, and a tail ironing apparatus for compressing the tail against the glue on the log, the improvement in combination therewith comprising:

a pivoting glue applicator having a glue transfer bar movable from a first position wherein the glue transfer bar is submerged in a glue reservoir to a second position out of the glue reservoir wherein the glue transfer bar is in contact with the log, wherein the glue applicator further comprises a plurality of supports extending between the glue transfer bar and a rotatable shaft for moving the glue transfer bar between the first and second positions, wherein the glue transfer bar is mounted to the plurality of supports and has an edge for applying the glue to the log that extends away from the plurality of supports;

a glue table positioned above the glue reservoir; and a log lift assembly having a plurality of fingers pivotable to move the log from the tail separator apparatus to the gluing apparatus while the tail is retained by a vacuum table intermediate the tail separator apparatus and the gluing apparatus.

12. The tail sealing apparatus of claim 11 wherein the fingers of the log lift assembly form a generally concave surface to support the log as it is moved from the tail separator apparatus to the gluing apparatus.

13. The tail sealing apparatus of claim 12 wherein the log is a first log and the log lift assembly further comprises a plurality of arms supporting the fingers and operative to block movement of a second log to the tail separator apparatus while the first log is moved from the tail separator apparatus to the gluing apparatus.

14. A method of ejecting a wound log from a tail ironing apparatus having three ironing rolls, the method comprising the step of moving a log eject arm between two of the ironing rolls substantially vertically and to the side of the third ironing roll to displace a log from between the ironing rolls, said log eject arm comprising a drag link and an angle bracket and being movable by pivotably coupling the angle bracket to said drag link and rotating the drag link about a pivot.

* * * * *